US005878510A

United States Patent [19]

Schoesler

[11] Patent Number: 5,878,510

[45] Date of Patent: Mar. 9, 1999

[54] FLUID FILLED INSOLE

[76] Inventor: Henning R. Schoesler, 1715 Chicago Ave., Suite 917, Evanston, Ill. 60201

[21] Appl. No.: 687,787

[22] Filed: Jul. 19, 1996

Related U.S. Application Data

[63] Continuation-in-part of Ser. No. 47,685, Apr. 15, 1993, abandoned.

[51] Int. Cl.[6] ..... A43B 13/38; A43B 7/14

[52] U.S. Cl. ..... 36/43; 36/71; 36/88; 36/153

[58] Field of Search ..... 36/43, 44, 71, 36/28, 29, 88, 93, 114, 153

[56] References Cited

U.S. PATENT DOCUMENTS

| | | | |
|---|---|---|---|
| D. 246,486 | 11/1977 | Nickel . | |
| D. 255,060 | 5/1980 | Okazawa . | |
| 1,093,608 | 4/1914 | Delaney . | |
| 1,148,376 | 7/1915 | Gay | 36/29 |
| 1,193,608 | 8/1916 | Poulson | 36/29 |
| 1,304,915 | 5/1919 | Spinney | 36/153 |
| 1,781,715 | 11/1930 | Blakely . | |
| 2,080,469 | 5/1937 | Gilbert . | |
| 2,080,499 | 5/1937 | Nathansohn | 36/29 |
| 2,488,382 | 11/1949 | Davis | 36/153 |
| 2,502,774 | 4/1950 | Alianiello . | |
| 2,917,844 | 12/1959 | Scholl . | |
| 3,765,422 | 10/1973 | Smith . | |
| 3,795,994 | 3/1974 | Ava . | |
| 3,871,117 | 3/1975 | Richmond et al. . | |
| 3,892,077 | 7/1975 | Wolstenholme et al. . | |
| 3,922,801 | 12/1975 | Zente . | |
| 3,990,457 | 11/1976 | Voorhees . | |
| 4,100,686 | 7/1978 | Sgarlato et al. . | |
| 4,115,934 | 9/1978 | Hill . | |
| 4,123,855 | 11/1978 | Thedford . | |
| 4,183,156 | 1/1980 | Rudy | 36/29 |
| 4,217,705 | 8/1980 | Donzis | 36/44 |
| 4,219,945 | 9/1980 | Rudy | 36/44 |
| 4,297,797 | 11/1981 | Meyers . | |

(List continued on next page.)

FOREIGN PATENT DOCUMENTS

| | | |
|---|---|---|
| A-27666/84 | 12/1984 | Australia . |
| 3629331A1 | 3/1988 | Germany . |
| 1-126905 | 5/1989 | Japan . |

OTHER PUBLICATIONS

Pittsburgh Plastics Manufacturing fluid filled insole which was believed to have been commercially introduced and sold in or about Mar. 1993.

*Primary Examiner*—M. D. Patterson
*Attorney, Agent, or Firm*—Juettner, Pyle, Piontek & Underwood

[57] ABSTRACT

A fluid filled insole comprises a fluid tight bladder having upper and lower layers and a generally foot-shaped, planar configuration, with proximal forefoot, midfoot and hindfoot regions; a heavy, viscous, sterile liquid substantially filling the bladder; at least two but no more than six transversely spaced forefoot flow deflectors joining the upper and lower layers in the proximal forefoot region of the bladder; at least one but no more than five transversely spaced hindfoot flow deflectors joining the upper and lower layers in the hindfoot region of the bladder; flow passages matched to the anatomical structure of the foot between the forefoot and hindfoot flow deflectors and the medial and lateral and peripheral margins of the bladder; a flow controller matched to the border between the lateral and medial longitudinal arch, whereby liquid flows from the hindfoot region to the forefoot region and vice versa. The flow through the insole passages and channels matches the anatomical structure of the foot; disperses the user's weight evenly over the area of the foot, thereby reducing peak pressures on the plantar surfaces of the user's foot; provides directional stability when using the insole for walking, running or standing; improves the venous pump function with resulting medical benefits; and ensures an accumulation of liquid under the medial arch of the user's foot to form a liquid pillow that matches the anatomical structure of the medial longitudinal arch.

12 Claims, 8 Drawing Sheets

U.S. PATENT DOCUMENTS

| | | | |
|---|---|---|---|
| 4,336,661 | 6/1982 | Medrano . | |
| 4,471,538 | 9/1984 | Pomeranz . | |
| 4,472,890 | 9/1984 | Gilbert . | |
| 4,567,677 | 2/1986 | Zona . | |
| 4,590,689 | 5/1986 | Rosenberg . | |
| 4,602,442 | 7/1986 | Revill et al. . | |
| 4,799,319 | 1/1989 | Zellweger . | |
| 4,845,861 | 7/1989 | Moumdjian | 36/29 |
| 4,934,070 | 6/1990 | Mauger . | |
| 4,934,072 | 6/1990 | Fredericksen et al. | 36/28 |
| 5,067,255 | 11/1991 | Hutcheson . | |
| 5,097,607 | 3/1992 | Fredericksen | 36/28 |
| 5,313,717 | 5/1994 | Allen et al. . | |
| 5,406,719 | 4/1995 | Potter | 36/28 |

FIG. 1-B

FIG. 1-C
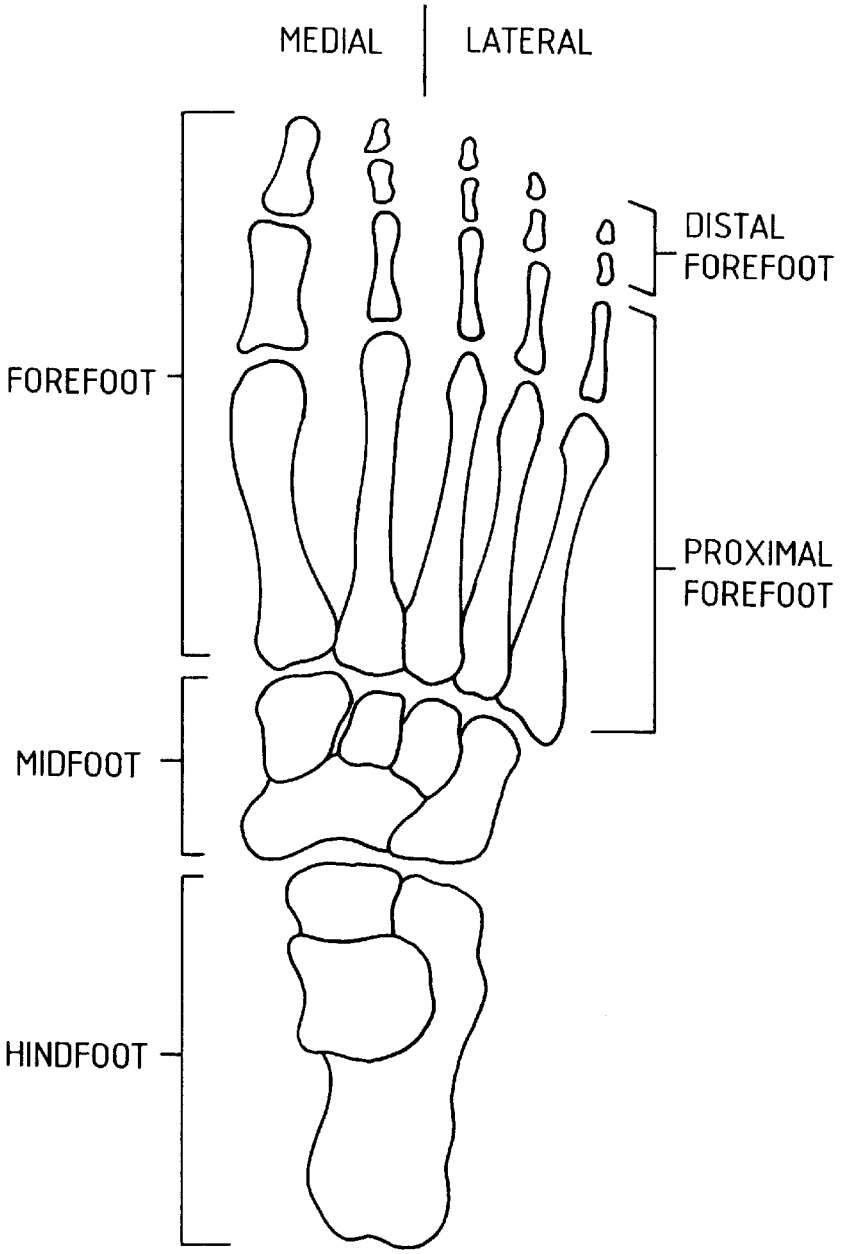
FIG. 2
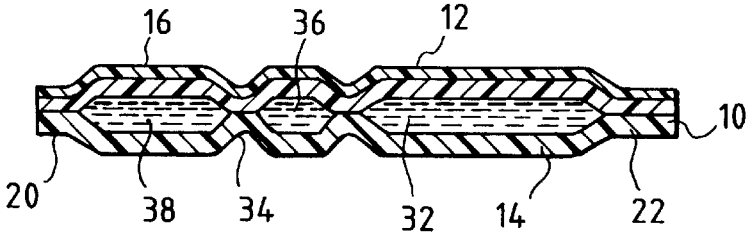

FLUID FILLED INSOLE

CROSS REFERENCE

This application is a continuation-in-part of application Ser. No. 08/047,685 filed on Apr. 15, 1993, now abandoned.

BACKGROUND OF THE INVENTION

The present invention is directed to therapeutic fluid filled insoles, and more particularly to insole bladders having fluid flow directing and restricting members within the bladder with the purpose of achieving improved medical benefits and directional stability to the users.

Fluid filled insoles have long been known in the art, see for example, U.S. Pat. No. 4,567,677 to James Zona, U.S. Pat. No. 4,115,934 to Hall, U.S. Pat. No. 4,123,855 to Thedford, U.S. Pat. No. 2,080,469 to Gilbert and U.S. Design Pat. No. D246,486 to John W. Nickel. Prior art insoles commonly comprise a bladder having an upper layer and a lower layer. The two layers are welded together at their marginal periphery. The bladder has a planar, foot-shaped configuration, which includes a forefoot region, a hindfoot region, and a midfoot region there between. The bladder is filled with a fluid, such as water or air. The broader technical functions of fluid filled insoles are well documented, whereas the medical benefits are only partly documented. It is not generally known that fluid filled insoles may be designed to accomplish specific medical benefits. The known technical functions include cushioning of the feet by a massaging action on the plantar surface of the feet due to movement of the fluid within the bladder, thus achieving comfort to the user.

The fluid filled insoles of the prior art have not been entirely satisfactory, however, in the area of providing demonstrative medical benefits, neither as a device for eliminating or relieving fatigue in the lower extremities by providing stress distribution and activation of the venous pump function nor for achieving directional stability to the user when wearing the insole. Existing prior art insoles have little or no means for controlling both the transverse and longitudinal flow and the rate of fluid flow within the insole nor for matching the flow of fluid to the anatomical structure of the foot. As a user walks, the user's weight is initially applied to heel, and then is transferred to the ball of the foot. This causes the fluid within the bladder to move, respectively, from the hindfoot region to the forefoot region and then back towards the hindfoot again. Without means for directing fluid flow anatomically within the bladder, the fluid will flow uncontrollably and thus causing directional instability to the user when wearing the insole. Without means for controlling and restricting the rate of fluid flow vis-a-vis viscosity and density of the fluid, the user's feet will simply jump through the fluid, and thus the fluid insole has no cushioning or massaging effect.

Some prior art devices, such as the insole of the Zona patent, have attempted to regulate flow from the hindfoot region to forefoot region and vice versa by placing flow restricting means in the midfoot area of the bladder. These flow restricting devices are only partly effective, however, since they neither match the anatomical structure of the foot nor regulate or direct the flow within the forefoot or hindfoot regions of the bladder to achieve directional stability and local stress distribution. In addition, the midfoot flow restricting means are not matched to the longitudinal medial anatomical structure of the arch. Matching the anatomical structure of the foot to the location, direction, quantity and duration of fluid flow are important to achieve therapeutic benefits, stress distribution and directional stability.

Some prior art insoles, as shown for example in the Hall or Nickel patents have attempted to regulate fluid flow within the forefoot and hindfoot regions. But, these efforts have not been satisfactory because the fluid flow is not matched to the anatomical structure of said regions, but rather directed to the outer, medial and lateral, margins of the insole, away from the areas of the foot where fluid massaging action and pressure distribution is required when considering the physiology and anatomy of the foot.

The Thedford patent has also attempted to regulate fluid flow within the forefoot and hindfoot regions. These teachings have not been satisfactory because the fluid flow is neither adapted to the anatomical structure of the foot nor arranged in a fashion that achieves directional stability to the user during the flow of fluid within the insole. Further, the Thedford patent teaches prohibition or blocking of longitudinal flow within the bladder, redirecting the flow in a transverse direction.

The Gilbert patent has attempted to regulate fluid flow by randomly dispersing flow restrictors across the entire surface of the insole, which, again, does neither match the anatomical structure of the foot nor achieve directional stability. The Gilbert patent does not specify any particular arrangement of flow restrictors or fluid flow, but teaches that the "spots" "may be disposed at any desirable location with any desirable frequency" which makes flow control indefinite. Further, the Gilbert patent permits air to shift in any direction and partly arranges flow restricting means to block longitudinal flow.

Many prior art insoles are filled with ordinary water or other fluids that not only quickly evaporate and thus significantly reduces the industrial applicability (life time) of the insole, but also develops bacteria and/or other microorganisms, causing the fluid to become toxic and thus environmentally unsafe. In addition, existing prior art insoles do not consider the fluid itself as a flow restricting means and thus significantly limits the therapeutic value of the insole by allowing the fluid to flow at a rate that cannot satisfactorily provide pressure distribution.

Finally, none of the prior art insoles considers local pressure distribution within the midfoot, forefoot and hindfoot regions of the bladder by directing, controlling and restricting the flow of fluid within the midfoot, forefoot and hindfoot regions. This lacking consideration significantly limits the medical and therapeutic applications of the prior art insoles. It would be desirable to have a fluid filled insole that (i) controls and directs the fluid to match the anatomical structure of the foot and achieve directional stability to the user wearing the insole, (ii) maximizes even pressure distribution to minimize peak pressures on the foot, both across the entire area of the foot and within each of the hindfoot, midfoot and forefoot regions, (iii) ensures minimum evaporation of the fluid to maximize the life time of the insole, (iv) provides a fluid that is environmentally safe, and (v) devises a fluid that functions as a flow restricting means vis-a-vis the density and viscosity of said fluid, and which otherwise overcomes the limitations inherent in the prior art.

OBJECTS OF THE INVENTION

It is an object of the invention to provide an insole that has a superior therapeutic fatigue-relieving effect by providing maximum pressure distribution in each of the hindfoot, midfoot and forefoot areas of the plantar surface of the user's foot, thereby improving the venous pump function and increasing blood circulation.

It is a further object of the invention to provide a fluid filled insole wherein the fluid flow matches the anatomical structure of normal feet; the fluid being directed and controlled in transverse and longitudinal flow passages that are adapted to the anatomical structure of normal feet, thereby achieving directional stability for the user when wearing the insole.

It is another object of the invention to provide a liquid filled insole that maximizes even distribution of the user's weight both over the total area of the foot and within each of the hindfoot, midfoot and forefoot regions, reducing peak pressures on the plantar surfaces of the user's feet.

It is a fourth object of the invention to provide an insole filled with a sterile, non-toxic, non-greasy fluid that not only has low evaporation and diffusion rates but also remains non-toxic during the entire life time of the insole.

It is a fifth object of the invention to provide a liquid filled insole that is durable and not prone to lose fluid by leakage, evaporation or diffusion, thus prolonging the life time of the insole.

It is a sixth object of the invention to provide a fluid filled insole that maximizes even pressure distribution within each of the forefoot, midfoot and hindfoot regions by (i) restricting the flow of liquid between the three regions and by (ii) directing and controlling the liquid within each of the regions (local pressure stress distribution).

It is a seventh object of the invention to provide a fluid filled insole that provides shock absorption in the heel area and maximizes even pressure distribution within each of the forefoot and midfoot regions.

It is an eighth object of the invention to provide a fluid filled insole that accumulates as much liquid as possible within each of the hindfoot and forefoot areas.

SUMMARY OF THE INVENTION

The insole of the invention comprises a fluid tight bladder having an upper layer of flexible material and a lower layer of flexible material sealingly joined together at their peripheral margins. The bladder has a generally foot shaped planar configuration, with a proximal forefoot region, a hindfoot region, and a midfoot region there between. The bladder is filled with a large molecular, non-evaporable, highly viscous, sterile liquid, preferably a mixture of hygroscopic, polyvalent alcohol and distilled water. Within the proximal forefoot region of the bladder is positioned between two and five flow deflectors, equally spaced transversely one from the other, and spaced from the medial and lateral margins of the bladder. The flow deflectors comprise weld points joining the upper and lower bladder layers. Substantially equally sized longitudinal flow channels are formed between the flow deflectors and between the flow deflectors and medial and lateral margins of the bladder.

In the proximal part of the forefoot area is positioned a flow controller that restricts the flow of fluid between the proximal part of the forefoot region to the midfoot region and vice versa.

Between two and five, preferably two, flow deflectors are located in the hindfoot region of the bladder. At least one longitudinal hindfoot flow channel is formed between the heel flow deflectors, and at least two longitudinal channels are formed between the hindfoot flow deflectors and the medial and lateral margins of the bladder. Thereby, fluid flowing within the hindfoot and forefoot regions and from these regions into the midfoot region and vice versa will be channeled through the longitudinal flow channels in the forefoot and hindfoot regions in a controlled fashion, resulting in enhanced medical and therapeutic benefits as explained below.

The bladder is filled with a large molecular, non-evaporable, highly viscous, sterile liquid, preferably a mixture of hygroscopic, polyvalent alcohol and distilled water. The fluid has a viscosity and density of at least 1.10 times that of ordinary water. I refer to this as a "heavy liquid." For the above reasons, the density of the fluid, measured by g/m3, is higher than the density of water (density=weight), because a higher weight of the fluid (compared to water) restricts the flow of fluid. For the same reasons, the thickness (viscosity) is also higher than water, because a higher thickness of the fluid (compared to water) restricts the flow of fluid. This mixture is sterile, non-toxic and resistant to contamination by bacteria or other microorganisms, thereby ensuring an environmentally safe fluid within the insole. Further, the mixture of hygroscopic, polyvalent alcohol and distilled water is not susceptible to evaporation or diffusion through the bladder layers. It is also autoclavable. In the event of a bladder puncture, the liquid may be easily removed from clothing and footwear, as the mixture is relatively non-greasy.

The insole of the invention has been tested and found to provide several desirable medical and therapeutic benefits. The insole relieves fatigue during prolonged standing or walking by distributing the user's weight evenly and symmetrically over the area of the foot, thereby reducing peak pressures exerted on the plantar surface of the user's foot and the deformation of soft tissue. The reduction in pressure thereby further relieves stress on the bones of the foot that can cause foot pain, hard skin and in extreme situations, ulceration.

Second, the controlled flow of fluid through the bladder across the plantar surface of the user's feet provides a therapeutic movement of the small intrinsic muscles of the feet. The movement of the muscles animates the venous pump function increasing blood circulation, which in turn improves transport of oxygen and nutrients to the cells in the foot and removal of waste products excreted from the cells. Improved blood circulation reduces the amounts of lactic acid, thereby reducing the occurrence of myasthenia ("tired muscles").

Third, the specific locations of the flow deflectors enable a fluid flow that is matched to the anatomical structure of the foot and thus aid in physiologically correct walking and running. This in turn provides not only directional stability when the fluid moves within the insole, but also corrects the foot abnormalities over supination and over pronation found in asymmetric feet.

Other attributes and benefits of the present invention will become apparent from the following detailed specification when read in conjunction with the accompanying drawings.

BRIEF DESCRIPTION OF THE DRAWINGS

FIG. 1-B is a plan view of the human foot illustrating the medial and lateral portions thereof.

FIG. 1-C is a dorsal view of the bones of the human foot.

FIG. 2 is a cross-sectional view of the first embodiment of the invention taken along line 2—2 of FIG. 1.

DETAILED DESCRIPTION

Figure 1:
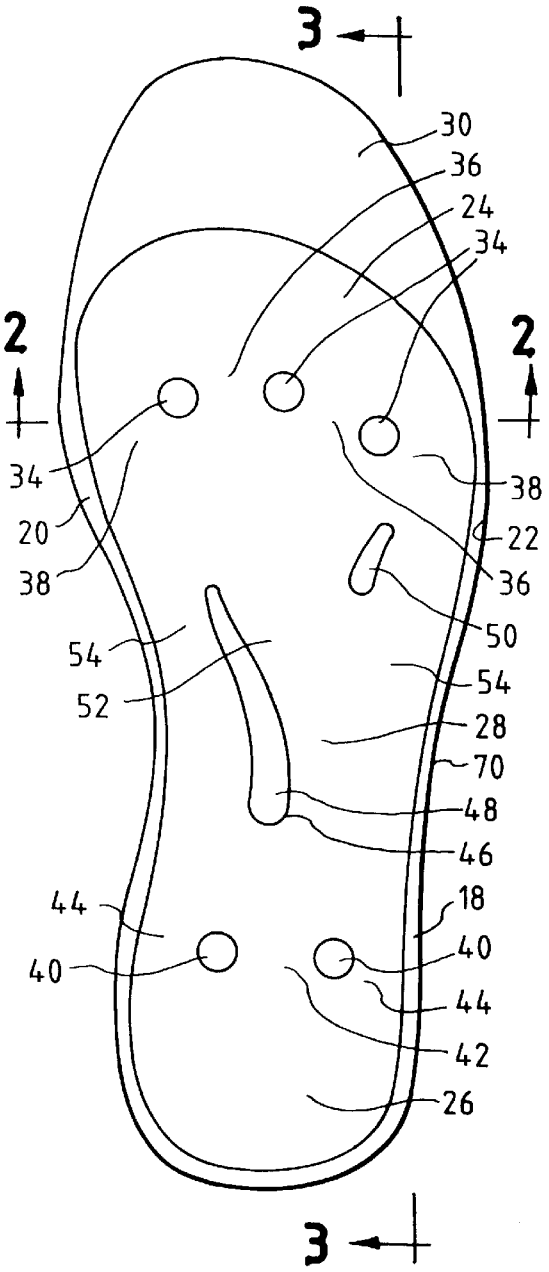
FIG. 1 is a plan view of a first embodiment of the fluid filled insole of the invention.
Figure 1:
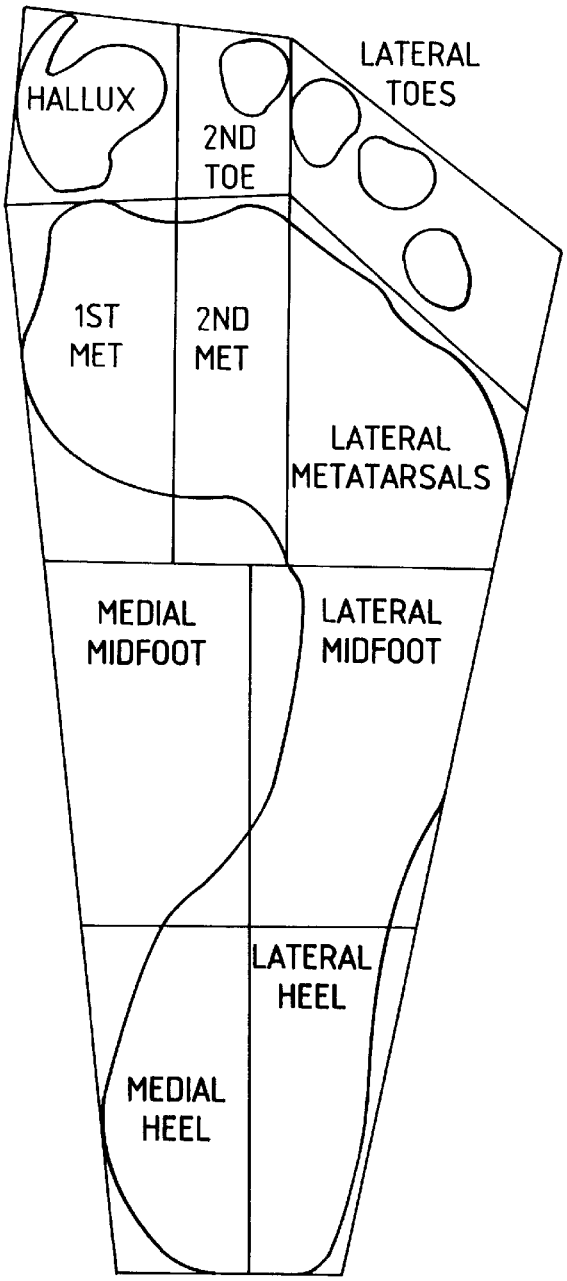

Turning now to the drawings, FIGS. 1-B and 1-C illustrate the structure of the human foot. The foot comprises a (i) hindfoot region containing the talus 1 and os calcis 2 bones; (ii) a midfoot region containing the cuneiform 3, cuboid 4 and navicular 5 bones; and the forefoot region comprising the metatarsals 6, the proximal phalanges 7, and the middle 8 and distal 9 phalanges. The forefoot region can be divided into two sub-regions, the distal sub-region comprising the middle and distal phalanges, and the proximal forefoot region which comprises the metatarsals and proximal phalanges. The foot also includes a longitudinal arch, having a medial and a lateral side. The medial longitudinal arch is defined by the navicular and medial cuneiform bones of the midfoot and the about the proximal half of the first, second and third metatarsals.

Figure 3:
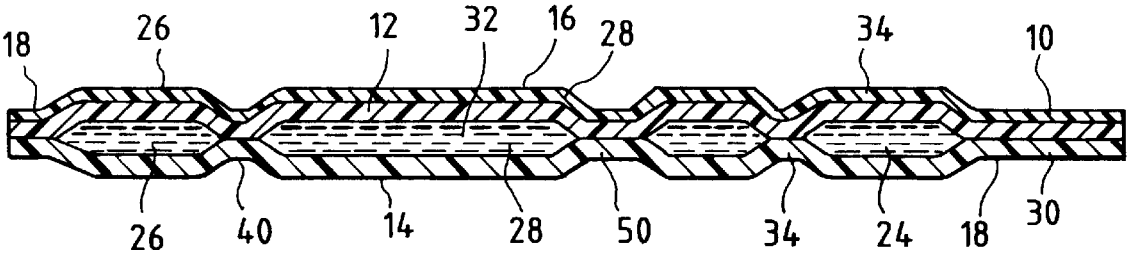
FIG. 3 is a cross sectional view of the first embodiment of the invention taken along line 3—3 of FIG. 1.

In FIGS. 1 through 3, a first embodiment of the fluid filled insole of the invention is shown. The insole comprises a bladder 10 having an upper layer 12 and a lower layer 14. The insole preferably further includes a layer of sweat absorbing material 16 substantially covering and laminated to the outer surface of upper layer 14. The bladder layers 12 and 14 are sealing joined at their peripheral margins 18. For reference, the medial peripheral margin is numbered 20 and the lateral peripheral margin is numbered 22. The bladder comprises three main regions, namely a forefoot region 25, a hindfoot region 26 and a midfoot region 28 therebetween. The forefoot region is divided into a distal subregion 30 and a proximal forefoot region 24.

The interior cavity 32 of the bladder 10 is filled with a sterile, non-toxic, non-evaporable fluid with a density and viscosity of at least 1.10 times that of water. The fluid is preferably a "heavy liquid" mixture of large molecular, hygroscopic polyvalent alcohol and distilled water, as is more fully described below. The fluid may flow between and throughout the proximal forefoot, midfoot and hindfoot regions. The distal forefoot sub-region preferably does not contain fluid. Within the proximal forefoot region 24 of bladder 22 there are at least two but no more than six transversely spaced flow deflectors 34. Preferably, there are three forefoot flow deflectors 34, but, one could employ between two and six forefoot flow deflectors. The shape of the flow deflectors is preferably circular or oval, but other shapes may alternatively be used. The distance between each of the flow deflectors and between the flow deflectors and the medial and lateral peripheral margins of the bladder forms longitudinal, substantially parallel, forefoot flow passages. Each flow passage has a substantially equal transverse dimension, $W_m$. By "substantially equal transverse dimension," I mean between 0.95 and 1.05 times $W_m$, where $W_m$ is calculated as follows:

$$W_m=(D_m-S_m)/(N_m+1)$$

$D_m$ is the maximum straight transverse width of the forefoot region, $S_m$ is the sum of the transverse dimensions of the forefoot flow deflectors, and $N_m$ is the number of forefoot flow deflectors.

The forefoot flow deflectors are arranged in a shape that laterally, medially, transversely and longitudinally matches the anatomical structure of the proximal forefoot region, the shape being for example, but not limited to, an arc, a semicircle, or a trapezoid, the convex side of the shape facing in a distal direction. The spacing between the flow deflectors depends on (i) the shoe or foot size, (ii) the diameter of the flow deflectors, and (iii) the number of flow deflectors. With two forefoot flow deflectors, the spacing from centerline to centerline between flow deflectors would be 33% or one third of the transverse straight distance between the lateral and medial peripheral margins of the bladder measured at the location of the flow deflectors. If n flow deflectors are placed in the proximal forefoot region, then n+1 longitudinal flow passages are formed.

The flow deflectors 34 are formed by weld points joining the upper blade layer 12 to the lower bladder layer 14. Formation of flow deflectors by welding points joining the bladder layers improves the structural integrity of the bladder, improving durability. Between flow deflectors 34 are flow passages 36 through which fluid flows during use of the insole. Additional flow passages 38 are also formed in the proximal forefoot region between flow deflectors 34 and the medial peripheral margin 20, and between flow deflectors 34 and the lateral peripheral margin 22. The forefoot flow passages 36 and 38 extend in a straight, unobstructed, longitudinal direction. By "longitudinal" it is meant that the flow direction varies by no more than 10 degrees (plus or minus) from the straight longitudinal axis of the insole. Flow deflectors 34 are shown as being circular, but other shapes, such as oval or ellipse, may be alternatively used.

In the hindfoot region 26 of bladder 10 there are at least one but no more than five flow deflectors 40. Because the hindfoot region is a smaller area than the forefoot region, two flow deflectors are preferably used. Alternatively, one, three, four or five could be used. The hindfoot flow deflectors 40 are formed in the same manner as the forefoot flow deflectors, by a weld point joining the upper and lower bladder layers 12 and 14. At least one generally longitudinal flow passage 42 is formed between hindfoot flow deflectors 40, if two or more hindfoot deflectors are used. Additional hindfoot flow passages 44 are formed between hindfoot deflectors 40 and the medial and lateral peripheral margins of the bladder.

Bridging the proximal forefoot region and the midfoot region 28 of bladder 10 are flow controllers 46, which are generally matched to the wearer's arch. The arch flow controllers may be configured in several different ways, but must match the contour or anatomical structure of the longitudinal arches of a normal foot, as described above in reference to FIGS. 1-B and 1-C. The lateral edge of the longitudinal medial arch is generally an elongated semicircle line at the longitudinal border of the lateral and medial arch of a normal foot, such as shown in FIG. 1-B. The longitudinal medial arch extends from the proximal part of the midfoot area to about the mid-point of the metatarsals, as shown in FIG. 1-B, defining an arch area 29. Flow controller 48 is shaped and located to match at least a portion of the border between the medial and lateral longitudinal arch. A somewhat restricted, central flow channel 52 is formed between controllers 48 and 50. Side flow channels 54 are formed between the flow controllers 46 and the peripheral margins 18 of bladder 10.

Figure 4:
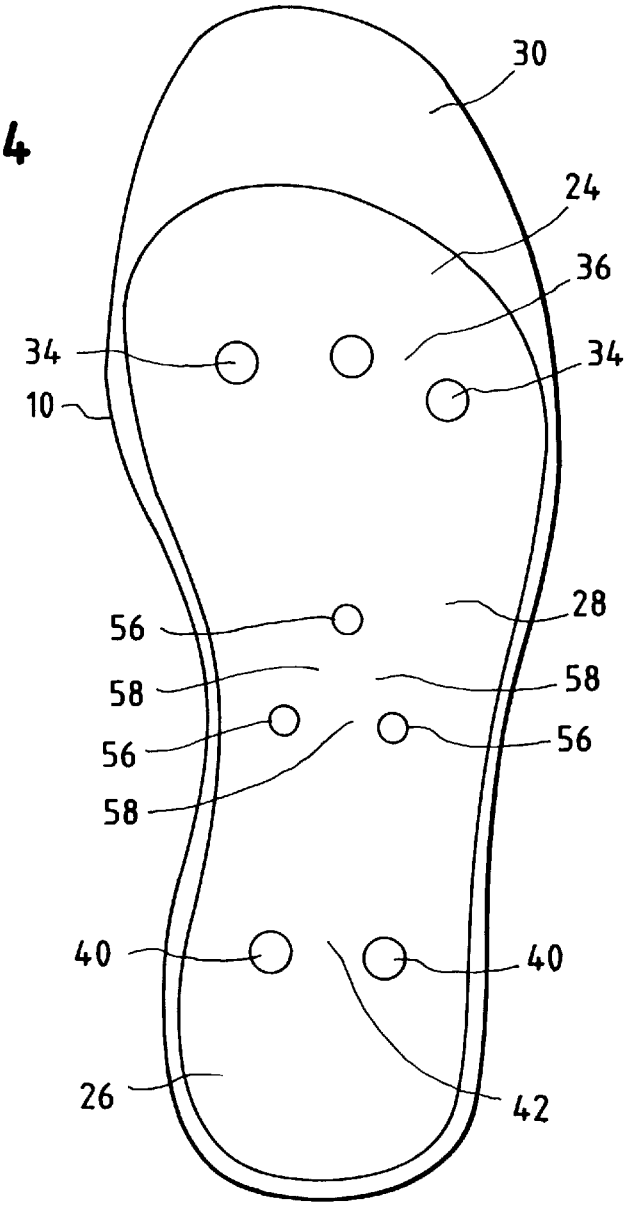
FIG. 4 is a plan view of a second embodiment of the invention.

The second through sixth embodiments of the fluid filled insole of the invention, FIGS. 4 through 8, are identical in all respects except that alternative flow controllers in the arch area 29 of the bladder are employed. The second embodiment of the invention, illustrated in FIG. 4, shows a flow controller comprising three weld points 56 joining the upper and lower bladder layers. Arch flow channels 58 are formed between the weld points.

Figure 5:
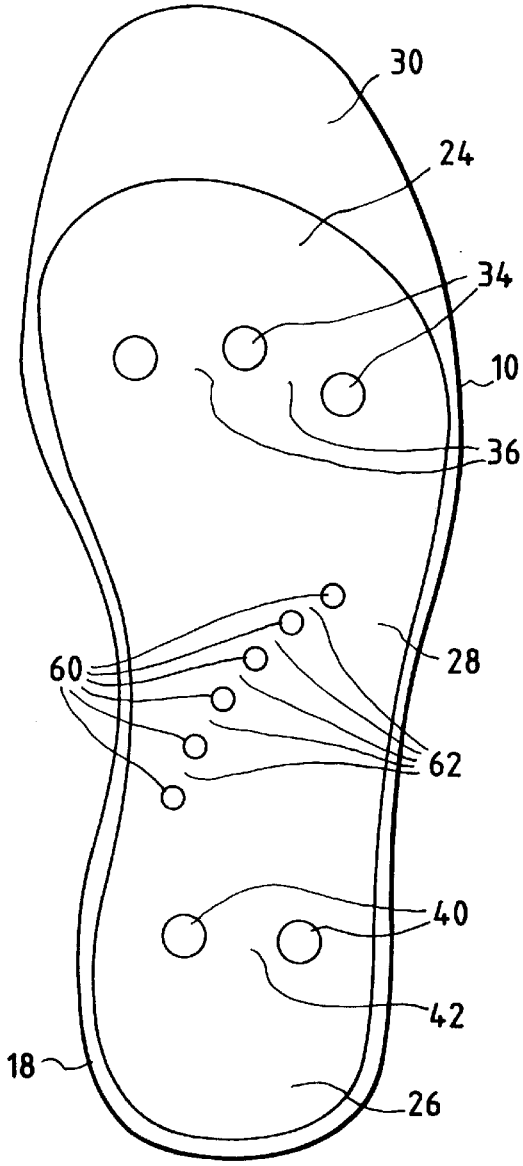
FIG. 5 is a plan view of a third embodiment of the invention.

FIG. 5 shows the third embodiment of the insole of the invention. The flow controllers in the arch region comprises a multiplicity of weld points 60 arranged in a diagonal arc. Plural flow channels 62 are formed between the weld points.

Figure 6:
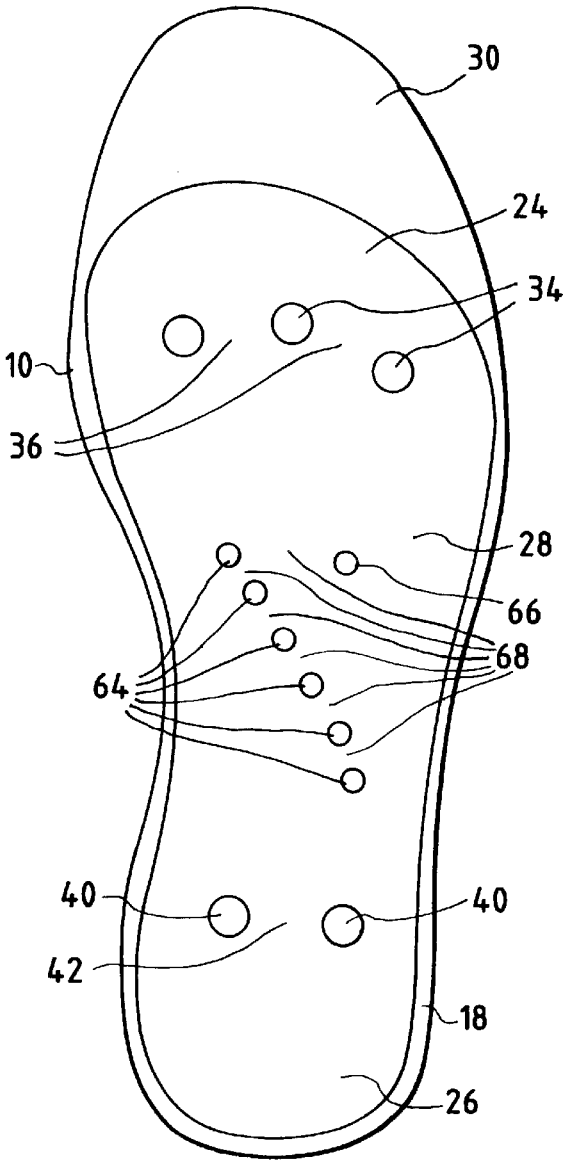
FIG. 6 is a plan view of the fourth embodiment of the invention.

FIG. 6 illustrates a fourth embodiment of the fluid filled insole of the invention. The fourth embodiment is characterized by a multiplicity of weld points 64 arranged in a semicircular elongated line that matches the anatomical structure of the medial longitudinal arch, such as depicted in FIG. 1-B, and that is located at the border between the lateral and medial longitudinal arches. Arch flow channels 68 are formed between the weld points.

Figure 7:
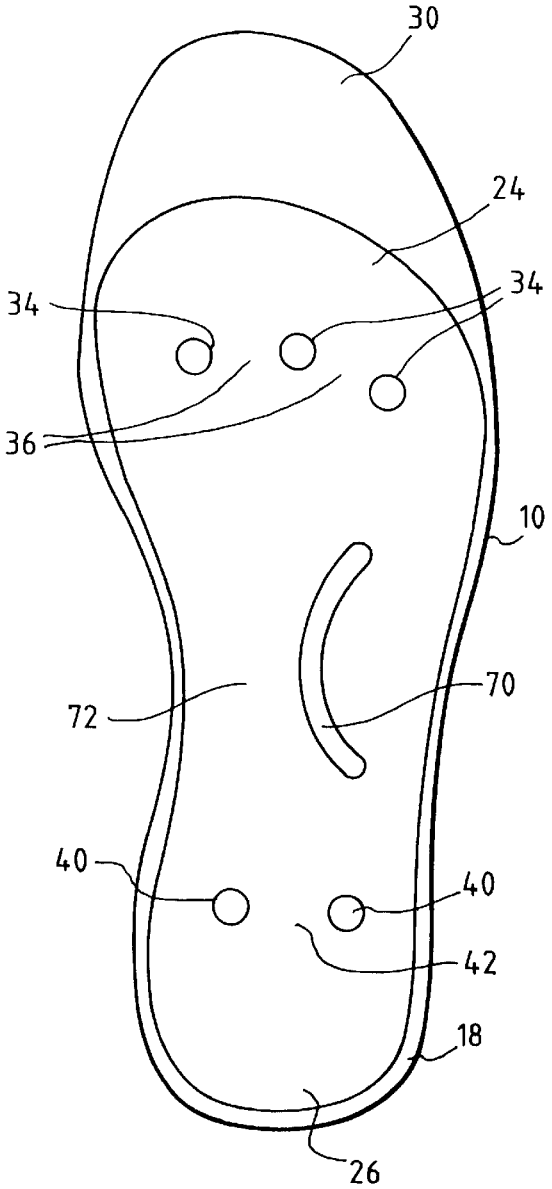
FIG. 7 is a plan view of a fifth embodiment of the invention.
Figure 8:
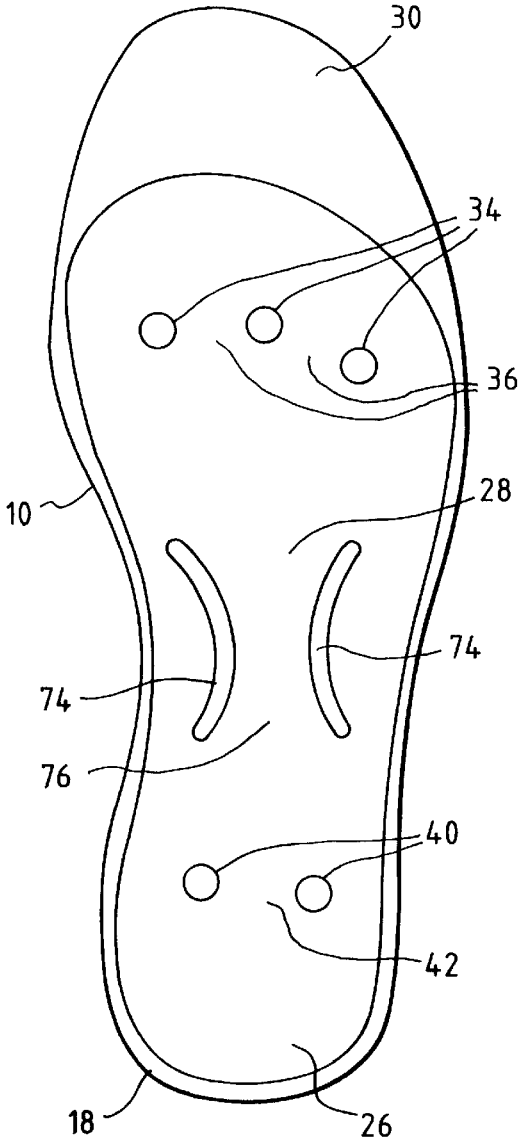
FIG. 8 is a plan view of a sixth embodiment of the invention.

FIGS. 7 and 8 illustrate, respectively, fifth and sixth embodiments of the fluid filled insole of the invention. The fifth embodiment has a longitudinal arch flow controller comprising a single elongated semicircle shaped weld 70, between the upper and lower bladder layers, forming adjacent flow channel 72. The sixth embodiment has a longitudinal arch flow controller comprising two elongated semicircle shaped welds 74 forming an interior flow channel 76.

Figure 9:
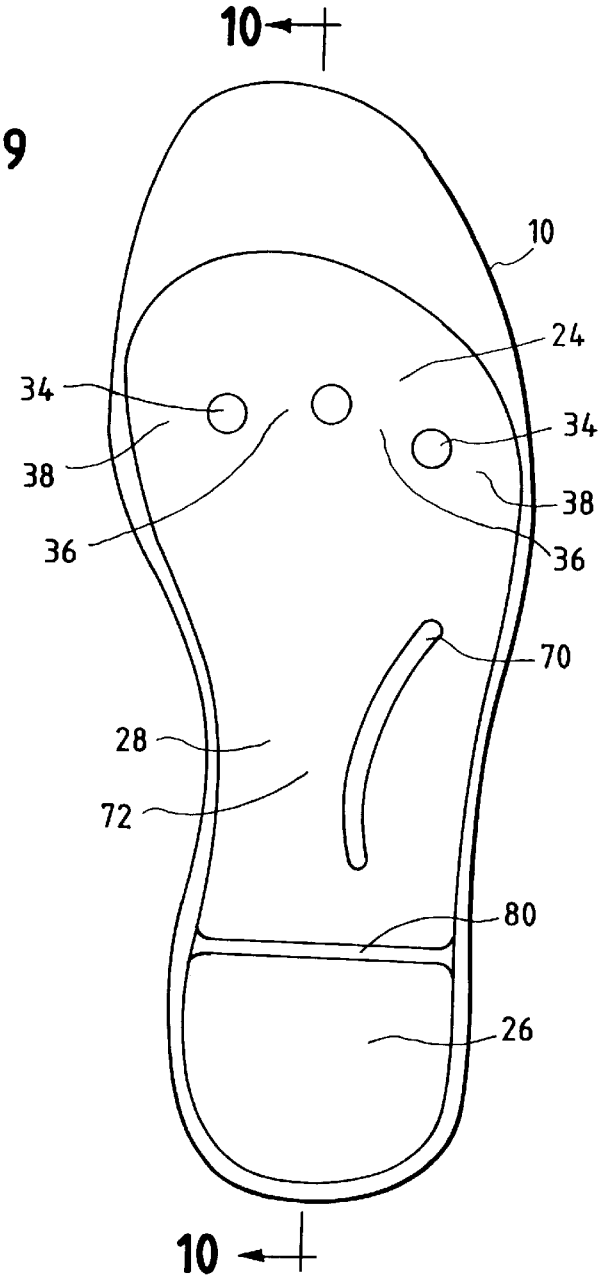
FIG. 9 is a plan view of a seventh embodiment of the invention.
Figure 10:
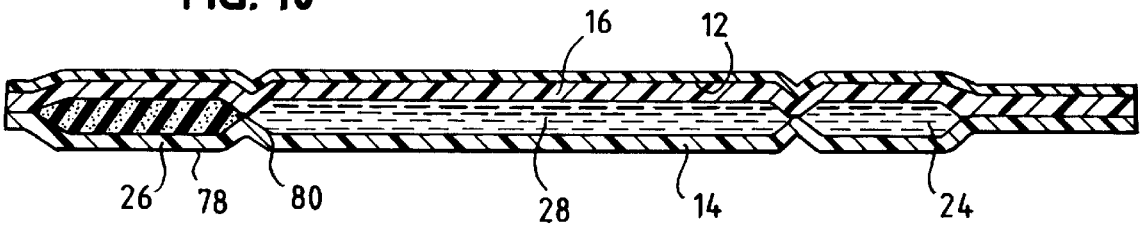
FIG. 10 is a cross-sectional view of the seventh embodiment of the invention taken along line 10—10 of FIG. 9.

FIG. 9 and 10 illustrate a seventh embodiment of the invention. The seventh embodiment is similar to the fifth embodiment, FIG. 7, except for the construction of the hindfoot region, which comprises a shock absorbing foam material or a non-flowable, semi-solid gel, as opposed to a flowable liquid filled bladder. More specifically, the seventh embodiment comprises a bladder 10 having an upper layer 12 and a lower layer 14. A layer of sweat absorbing material 16 is laminated to the outer surface of the upper layer 14. The bladder 10 has a liquid filled proximal forefoot region 24 and midfoot region 28. The proximal forefoot region 24 includes transversely spaced flow deflectors 34 and longitudinal flow channels 36 and 38 as described above. The arch region 29 includes a flow controller 70 and flow passage 72. The insole further comprises a hindfoot region 26 and a distal forefoot region 30, but these latter two regions are not filled with flowable liquid. Rather distal forefoot region 30 is unfilled and hindfoot region 26 is filled with either a static, non-flowable, semi-solid gel or a shock absorbing foam cushion 78. A barrier wall 80 separates the liquid filled regions 24 and 28 from the hindfoot region 26 and prevents liquid from flowing from the proximal forefoot and midfoot regions into the heel region.

Figure 11:
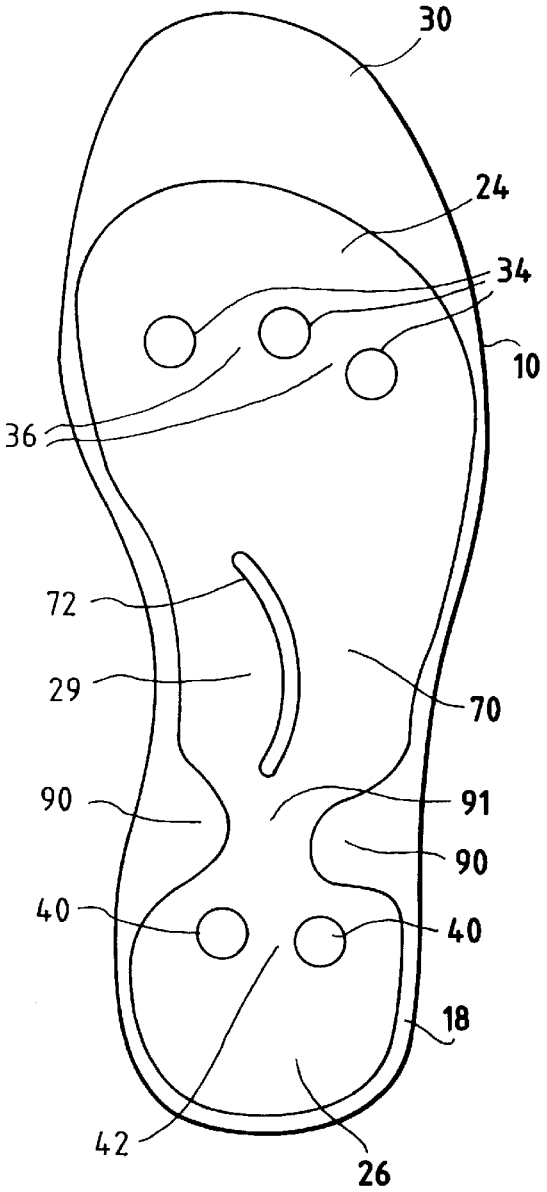
FIG. 11 is a plan view of an eighth embodiment of the invention.

The eighth to the eleventh embodiments of the fluid filled insole of the invention, FIGS. 11–14, show new flow restricting features in the arch region 29, in the distal part of the hindfoot region and in the proximal part of the proximal forefoot region. The four embodiments all have arch flow controllers similar to flow controller 46 and a shape similar to elongated semicircle line in FIG. 1-B. The numeration of said flow controllers is 72 in FIGS. 11–14. FIG. 11 shows the eighth embodiment of the invention. It is similar to FIG. 1 with a single longitudinal arch flow controller comprising a single elongated semicircular shaped weld 72 and, forming adjacent flow channel 70. The weld 72 is placed at the border between the longitudinal lateral and medial arches, such as depicted in FIG. 1-B, and being similar to weld line 48 in FIG. 1. In the distal part of the hindfoot region are placed hindfoot flow restrictors 90 adjacent to the lateral and medial peripheral margins, this pair of hindfoot flow restrictors defining a longitudinal channel 91 therebetween, the channel 91 having a transverse width of between 10 and 30 percent of the maximum straight transverse width of the hindfoot region of the bladder.

Figure 12:
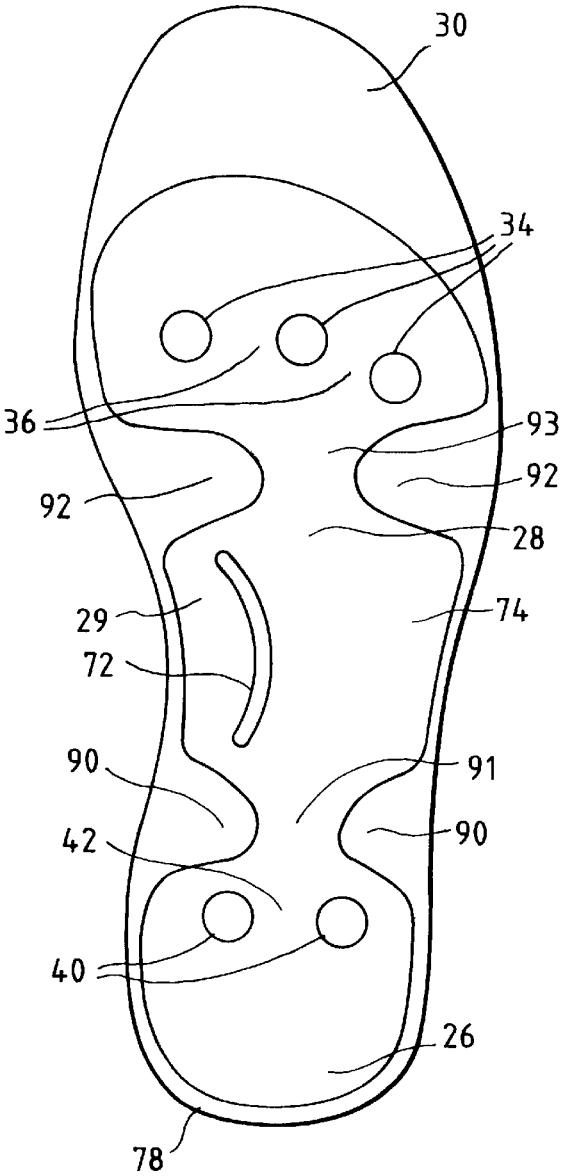
FIG. 12 is a plan view of a ninth embodiment of the invention.

FIG. 12 shows the ninth embodiment of the invention. It is similar to FIG. 11 except for the additional placement of a pair of flow restrictors 92 in the proximal end of the proximal forefoot region. One restrictor 92 is adjacent the medial peripheral margin, and the other is adjacent the lateral peripheral margin. The pair of restrictors 92 define a longitudinal flow channel 93 therebetween, the channel 93 having a transverse width that is less than 50% of the maximum straight transverse width of the proximal forefoot region of the bladder.

Figure 13:
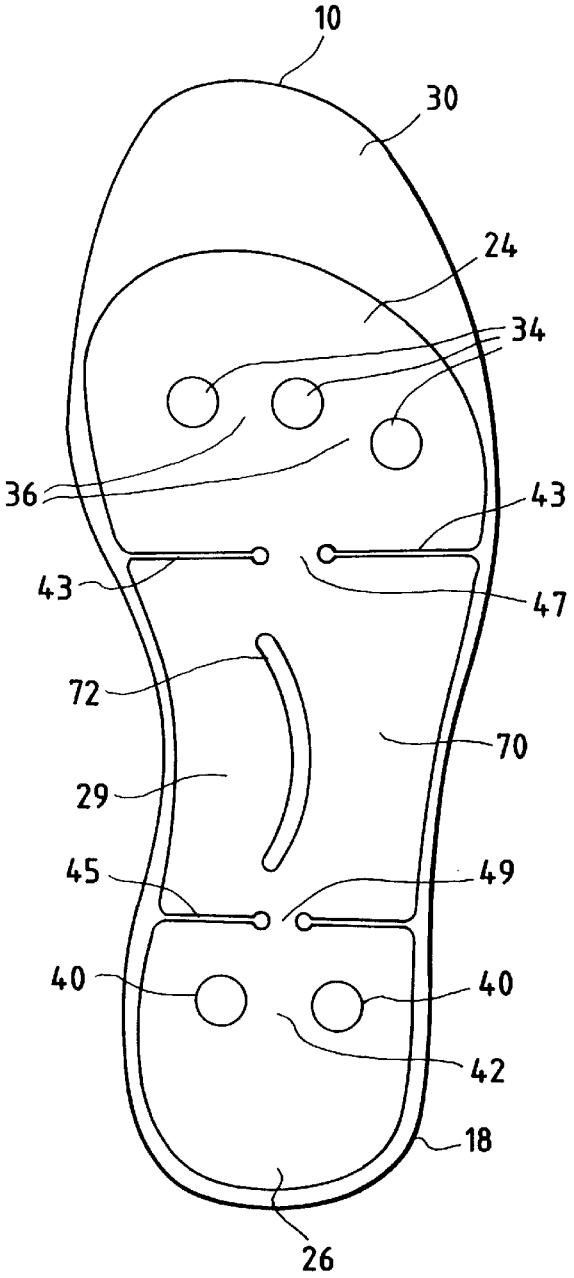
FIG. 13 is a plan view of a tenth embodiment of the invention.
Figure 14:
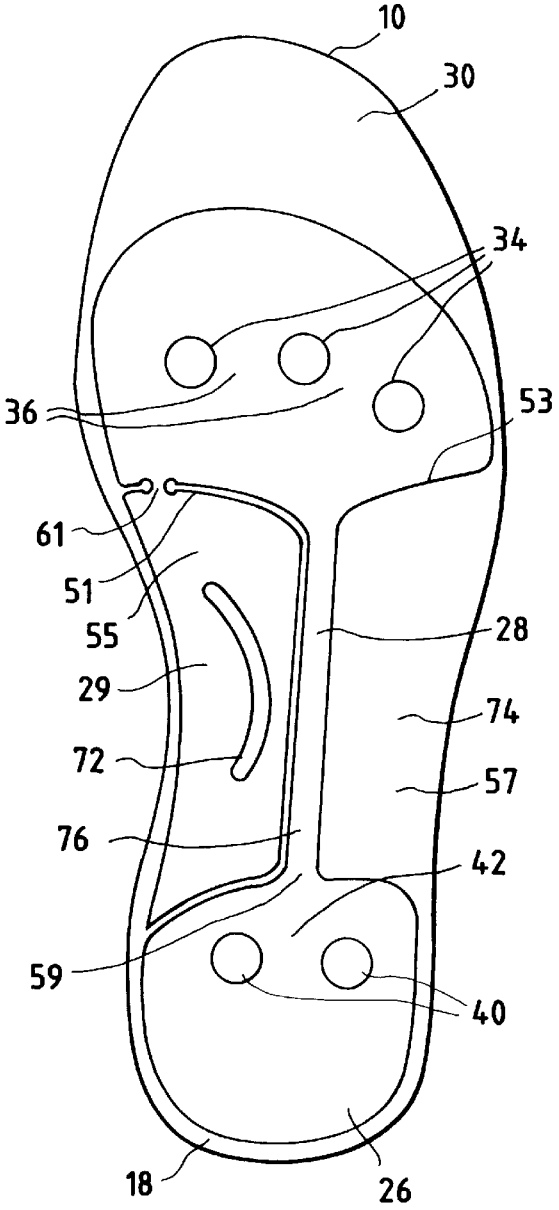
FIG. 14 is a plan view of an eleventh embodiment of the invention.

FIGS. 13 and 14 illustrate, respectively, tenth and eleventh embodiments of the fluid filled insole of the invention. The tenth embodiment, FIG. 13, shows a communicating compartmentalized structure of the insole. Substantially transverse walls 43 and 45 are formed at the intersections of (i) the proximal part of the proximal forefoot region and the distal part of the arch region, and (ii) the proximal part of the arch region and the distal part of the hindfoot region. The transverse wall 43 is located at the intersection between the proximal part of the forefoot region and the distal part of the longitudinal arch region have at least one opening, preferably one at the midpoint, forming a substantially straight longitudinal channel 47 through which the fluid can flow from the proximal forefoot region and into the midfoot region and vice versa. The size of the opening is between 10% and 25% of the straight distance between the lateral and medial peripheral margins measured at the location of said transverse wall. The opening is not limited to one but could be several openings. The opening is preferably placed at the midpoint on said transverse wall 43, but could be placed anywhere along said transverse wall.

The transverse wall 45 located at the border between the proximal part of the midfoot region area and the distal part of the hindfoot region has at least one opening, preferably one at the midpoint, forming a substantially straight longitudinal channel 49 through which the fluid can flow from the hindfoot region and into the midfoot region and vice versa. The size of the opening is between 10% and 25% of the straight distance between the lateral and medial peripheral margins measured at the location of the transverse wall. The opening 49 is not limited to one but could be several openings. The opening is preferably placed at the midpoint of the transverse wall, but could be placed anywhere along the transverse wall.

FIG. 13 has an arch flow controller identical to the one in FIG. 1, FIG. 11 and FIG. 12, comprising a single elongated semicircle shaped weld 72, between the upper and lower bladder layers, forming adjacent flow channel 70. In the area or volume defined by the longitudinal arch flow controller 72 and the medial peripheral margin of the bladder a liquid pillow is formed that matches the anatomical structure of the medial longitudinal arch region of a normal foot. The flow controller must have a shape as an elongated semicircle and be placed at the border between the lateral and medial arch of a normal foot. The width range is two to ten millimeters, depending on the foot or shoe size. In this way, liquid will flow from the proximal forefoot region and into the medial arch region, thus forming a liquid pillow under the area of the medial arch.

FIG. 14 shows an eleventh embodiment of the invention. The eleventh embodiment is generally a communicating, semi-compartmentalized structure in which the liquid is controlled by two elongated flow restrictors 51 and 53 extending from the proximal forefoot region to the hindfoot region. Thus, the entire longitudinal arch region is divided into two elongated flow restrictors 51 and 53 of substantially equal area. The two flow restrictors 51 and 53 are semicircular lines that form medial and lateral longitudinal arch areas 55 and 57. A substantially straight longitudinal channel 59 is formed in the arch region between the two flow restrictors 51 and 53 in which liquid flows from the proximal forefoot region through the longitudinal arch channel and into the hindfoot region. The lateral elongated flow restrictor 53 generally extends through the intersection between the longitudinal arch and proximal forefoot region and further to the lateral peripheral margin also at said intersection. The medial elongated flow restrictor 51 generally extends through the intersection between the longitudinal arch and proximal forefoot region and further to the medial peripheral margin also at said intersection.

In the lateral proximal corner of the proximal forefoot region, flow of liquid is blocked by the elongated lateral flow restrictor 53 and thus cannot flow into the lateral longitudinal arch region 57, but only through the longitudinal channel 59 between the two elongated flow restrictors. In the medial proximal comer of the proximal forefoot region, an opening 61 is made with the purpose of allowing liquid from the proximal forefoot region to flow into the medial longitudinal arch region 55. Thereby, liquid may accumulate within the area of the medial longitudinal arch. Thus, liquid may flow from the proximal forefoot region through both the longitudinal channel 59 between the two elongated flow restrictors and through the opening 61 at the medial border between the arch and proximal forefoot region. Medial longitudinal arch region 55 has an elongated, semicircular weld line 72 that is identical to weld line 72 in the medial midfoot area of FIG. 11.

The bladder is preferably fabricated from polyurethane sheet although other thermoplastic materials, such as EVA, PVC or vinyl may also be used. The thickness of each bladder layer should be from about 600 to 800 micrometers, 600 micrometers being preferred. The sweat absorbing material is preferably about 250 micrometers in thickness. The bladder may be formed by conventional radio frequency or dielectric welding techniques. Other welding techniques, such as thermal welding may be used alternatively. The bladder is filled with the liquid mixture leaving an opening in the peripheral weld, through which liquid may be introduced, then sealing the opening. The insole of the invention may be made and sold as an insole for removable placement in shoes by the user. Also, the insole may be built into footwear as a permanent feature.

The fluid used to fill the cavity 32 of the bladder 10 is a mixture of distilled water and a sterile, non-toxic, non-evaporable, large molecular, hygroscopic liquid to prevent evaporation or diffusion through the bladder. Polyvalent alcohols with large molecules and with non-toxic properties are preferred. One suitable formulation comprises approximately 85–98%, hygroscopic polyvalent alcohol and approximately 2–15% distilled water. By using this mixture in lieu of plain water, improved benefits are achieved: The mixture of the invention as compared to water does not evaporate or diffuse through the bladder layers, thereby significantly improving life time and durability of the insole. The liquid can withstand autoclaving as may be required by health care institutions. The insoles can be used in temperature ranges from minus 20 degrees Celsius to plus 120 degrees Celsius, because both the liquid mixture and bladder materials can withstand these temperature extremes. The liquid is fully sterile and non-toxic, and thus environmentally safe.

The sterility and/or non toxicness of the fluid is extremely important for several reasons. Children, people and animals could bite the insole, possibly drinking or swallowing the liquid. Water becomes septic after a few months of storage in some insoles, because bacteria will grow and flourish in the water.

Compared to water, the mixture of polyvalent alcohol and distilled water has a significantly higher density and viscosity. The fluid of the invention has a preferred density and viscosity range of at least 1.10 times that of water. The actual filling of fluid with a particular density that is at least 1.10 times that of water depends on the flow restricting means within the bladder. Generally, the more the flow of liquid within the bladder is restricted by flow restricting means in the forefoot, midfoot and hindfoot regions, the lower the requirement for the density and viscosity of the liquid. Inversely, the fewer flow restricting means within the bladder, the higher the density and viscosity required. The density and viscosity of the fluid causes an improvement in the effects on the user's foot when wearing the insoles, because the density and viscosity generally controls the rate of flow of the viscous liquid within the insole. In this way, the density and viscosity determine not only the degree of pressure distribution with following reduction of peak pressures on the plantar surface of the foot, but also directional stability.

The liquid used is a thick or heavy liquid that is resistant to flow, but not so thick that flow is unduly restricted. It is intended that when body weight is applied to one area of the bladder, the fluid will slowly and gradually flow out of the area over a few milli-seconds of time, thus the fluid is functioning as a flow restricting means and thereby enable an improved weight pressure distribution as compared to the fluid being ordinary water. The fluid will not "jump" out of an area upon application of load. I refer to this as a "heavy liquid. " For the above reasons, the density of said fluid, measured by g/m3, is higher than the density of water (density=weight), because a higher weight of the fluid (compared to water) restricts the rate of flow of fluid. For same reasons, the thickness (viscosity) is also higher than water, because a higher thickness of the fluid (compared to water) restricts the flow of fluid.

The liquid is relatively non-greasy. Thus, if the insoles are punctured or for any reason the liquid runs out into the user's socks or shoes, the shoes and socks may be readily cleaned.

Testing has shown that there are four basic beneficial effects from wearing the insoles of the invention, namely: (1) reducing stress on the foot; (2) improves the venous pump function by causing a movement of all the small intrinsic foot muscles; (3) symmetric walking, and (4) directional stability. Each of these therapeutic benefits will be explained in turn.

In the body, blood is pumped from the heart through the arteries out to the energy consuming muscles, where the blood carries the various energy substances such as carbohydrates and oxygen. Within the muscles, the energy is subsequently provided by an oxidation process in which carbohydrates interact with oxygen creating carbon dioxide, water and energy. If a person is working extremely hard—resulting in substantial use of muscles —the oxygen supplied to the muscles (through the blood supply) is insufficient to supply the muscles with sufficient energy. Energy may also be produced in the muscles by splitting of glycogen into lactic acid and energy. Glycogen is a substance in the muscles. The oxygen-poor blood and cell waste products that have resulted from the energy production will then be transported through the veins back to the heart and the purifying organs of the body. The veins function with the muscles to form a venous pump system that eases the transport of the blood back to the heart. The venous pump functions in cooperation with the muscle activity since the moving muscles cause the veins to stretch and contract. Since the veins internally are equipped with valves (flaps) that prevent the blood from flowing away from the heart, the muscle activity on the veins causes the veins to function as a pump system that significantly increases blood transportation back to the heart.

When an individual is standing or walking for more than four hours per day, the foot muscles may receive insufficient movement and exercise. Individual movement of the many small muscles in the foot is hindered. If the foot muscles have insufficient strength, they do not have the sustaining strength to maintain the weight of the body, and the heel bone and metatarsal bones may sink downwardly. The following chain reaction occurs:

1. When the feet collapse ("sink down"), the foot muscles are compressed, which reduces blood flow. Simultaneously, low muscle activity from the compression of the foot muscles causes a reduction of the venous pump function.
2. The foot muscles do not receive sufficient oxygen and carbohydrate quantities for maintaining adequate energy production and oxidation.
3. Because of the constant pressure and lack of supply of oxygen and carbohydrates, the foot muscles start to produce energy by splitting of glycogen to lactic acid and energy.
4. Because blood circulation is hindered, the process will accumulate lactic acid in the foot muscles.
5. Lactic acid causes tiredness, heavy legs, and later pain, depending on the length of time walking or standing.
6. The tiredness feeling tends to cause people to place themselves in inappropriate or awkward positions in an effort to remedy the feeling, again affecting other muscles, leading to pain in legs, back, head, etc.

With the insole of the invention, the movement of the liquid within the bladder will result in the user's body weight being more evenly distributed over the area of the foot; thus relieving peak pressures on the foot muscles. Further, the simultaneous movement of fluid within the bladder causes the small intrinsic foot muscles to move, which, combined with the stress distribution or stress effect, improves the venous pump function and thus avoiding the above chain reaction. Tests reveal that the insole of the invention reduces stress, measured by the average pressure in kilograms per square centimeter against the plantar surface of the user's foot. The improved spreading of the user's weight is particularly applicable during standing or walking. It is important to avoid high pressure on heel and metatarsal bones, since such pressure can cause foot pain, hard skin, and, in extreme situations, ulceration. These abnormalities are well known in diabetic feet.

The weight of the user pressurizes the liquid within the bladder. The pressurized liquid will constantly move the non-loaded parts of the bladder upwards. Movement or weight shift by the user will cause fluid movement, whereby a constant movement of the small internal foot muscles occurs. Considerably improved venous pump function is thereby established in the foot itself. A constant massage of the foot sole occurs for each time weight distribution is changed by the movement of the fluid within the three regions. When the feet, and thus the weight, is placed on the ground, a weight pressure redistribution action takes place between the feet and the insoles, stimulating the blood veins. The effect is a considerably improved venous pump function. Increased blood circulation is obviously very important for any person participating in a standing, walking or running activity. The function of the blood is to transport oxygen and nutrients to the cells, and return waste products to be excreted from the user's kidneys, through the urine. Improved blood circulation will decrease the amount of lactic acid, an element known as causing myasthenia ("tired muscles"). Blood circulation is thus very important to individuals applying their muscles extensively, since muscle exertion constrains the blood corpuscles, thus hampering the transport of nutrients and waste products. Another effect of insufficient blood supply is a reduction of the contraction ability of the muscles. The fluid filled insole of the invention enhances the location, amount and duration of beneficial stress distribution as compared to the prior art vis-a-vis the flow of fluid that is specifically matched to the anatomical structure of the foot (FIGS. 1-B and 1-C). A positive effect is a reduction and in many instances elimination of the painful effect of soreness in feet, legs, neck, head, and back caused by standing or walking for many hours a day.

The features that distinguishe the current invention from the prior art is further the specific location of the flow deflectors and restrictors in the forefoot, midfoot and hindfoot regions, enabling a flow of fluid matched to the structure of the bones of the feet. The flow deflectors and restrictors and their following flow passages ensure directional stability during locomotion by enabling a controlled circulation of liquid that is matched to the anatomical structure of the normal foot. This is important since uncontrolled liquid circulation would result in unstable walking, unstable weight distribution, and potentially the development of foot abnormalities. Directional stability, as achieved by the designed liquid circulation of the invention and as distinguishable over the prior art, ensures a symmetric locomotion pattern for the wearer, because the weight is resting on the foot's natural points and the weight is more evenly distributed on the foot. The function is similar to waterbeds. Obviously, the weight is the heaviest where one first places his foot on the ground, which is, logically, individual from person to person. The insole can help the problems involved in over-supination and over-pronation, i.e., where the user's feet are turning abnormally either to the medial, inner side or the lateral, outer side of the foot ("asymmetric feet"). The combination of dispersing of weight pressure and directionally stabilizing fluid circulation also supports a functionally correct take-off; a factor crucial for walking or running in a physiologically correct manner.

What is claimed is:

1. An improved insole adapted to be worn beneath the wearer's foot, said insole of the type in which a bladder is filled with a fluid, said bladder having a generally foot-shaped configuration with a proximal forefoot region, a hindfoot region and a midfoot region therebetween, wherein the improvement comprises:

at least two but no more than six transversely spaced flow deflectors in the proximal forefoot region of said bladder, said deflectors being equally spaced apart relative to one another;

at least three, but no more than seven forefoot flow passages between each of said flow deflectors and between said flow deflectors and the lateral and medial margins of the proximal forefoot region of said bladder, said forefoot flow passages having substantially equal transverse dimension, and at least one of said forefoot flow passages extending between the proximal forefoot region and the midfoot region of said bladder;

at least one but not more than five transversely spaced flow deflectors in the hindfoot region of said bladder;

at least one but not more than six flow passages between said hindfoot flow deflectors and between said hindfoot flow deflectors and the lateral and medial margins of said bladder, said hindfoot flow passages having substantially equal transverse dimension, and at least one of said hindfoot flow passages extending from the hindfoot region into the midfoot region of said bladder;

a pair of flow restrictors at the distal end of the hindfoot region of said bladder, one of said restrictors adjacent the medial peripheral margin of said bladder and the other adjacent the lateral peripheral margin of said bladder, said pair of restrictors defining a longitudinal flow channel therebetween; and said fluid comprising a heavy, viscous liquid.

2. An improved insole as in claim 1, further comprising a pair of flow restrictors in the proximal end of said proximal forefoot region, one said restrictors adjacent the medial peripheral margin of said bladder and the other adjacent the lateral peripheral margin, said pair of restrictors defining a longitudinal flow channel therebetween, said channel having a transverse width that is less than 50 per cent of the maximum straight transverse width of the proximal forefoot region of said bladder.

3. An improved insole as in claim 1, wherein said longitudinal flow channel at the distal end of the hindfoot region has a transverse width of between 10 and 30 percent of the maximum straight transverse width of the hindfoot region of said bladder.

4. An improved insole as in claim 1, the wearer's foot having a lateral and medial longitudinal arches and a border therebetween, said insole further comprising an elongated flow controller, at least partially in the midfoot region of said bladder, the elongation of said flow controller substantially matching the border between lateral and the medial longitudinal arch of the wearer's foot, said flow controller controlling liquid flow from said hindfoot region to said proximal forefoot region and vice versa, and defining a semi-enclosed volume in which accumulation of liquid occurs when liquid flows into the longitudinal arch region, said accumulation forming a liquid pillow underlying the medial arch area of the wearer's foot.

5. An improved insole as in claim 1, wherein said bladder comprises an upper layer and a lower layer joined at their peripheral margins, said bladder further comprising a layer of sweat absorbing material laminated to and substantially covering the outer surface of said upper layer, said material for absorbing perspiration.

6. An improved insole as in claim 1, wherein each said forefoot flow passage has a transverse dimension that varies no more than ten percent from any other forefoot flow passage.

7. An improved insole as in claim 1 wherein said bladder comprises an upper layer and a lower layer of thermoplastic film, each said bladder layer being of about 600 to about 800 micrometer thickness, said bladder layers being welded to each other at their peripheral margins.

8. An improved insole as in claim 1, wherein said insole is incorporated into footwear.

9. An insole adapted to underlie the anatomical structure of the wearer's foot, the foot having a lateral longitudinal arch, a medial longitudinal arch and a longitudinal border therebetween, comprising a lower layer of substantially impermeable, flexible material;

an upper layer of substantially impermeable, flexible material;

said upper and lower layers being sealingly joined to one another at their peripheral margins, said upper and lower layers forming a substantially fluid tight bladder, said bladder having a generally planar, foot-shaped configuration having distal forefoot region, a proximal forefoot region, a hindfoot region and a midfoot region therebetween, and a liquid barrier between said distal forefoot region and said proximal forefoot region;

at least two but no more than six transversely spaced forefoot flow deflectors between said upper material layer and said lower material layer in said proximal forefoot region;

forefoot flow passages between said forefoot flow deflectors and between said forefoot flow deflectors and the medial and lateral margins of said bladder, each said forefoot flow passages having a substantially equal transverse dimension;

at least one of said forefoot flow passages extending between said proximal forefoot region and said midfoot region;

at least one but no more than five transversely spaced hindfoot flow deflectors between said upper material layer and said lower material layer in said hindfoot region;

hindfoot flow passages between each of said hindfoot flow deflectors and between said hindfoot flow deflectors and the medial and lateral margins of said bladder, each said hindfoot flow passage having a substantially equal transverse dimension;

at least one of said hindfoot flow passages extending between said hindfoot and midfoot regions;

a sterile, heavy, viscous liquid within said bladder, said liquid comprising about 85 to 98 percent large molecular, polyvalent hygroscopic alcohol and about 2 to 15 percent distilled water, said liquid flowable from said hindfoot region to said proximal forefoot region and vice versa and flowable through said forefoot flow passages and said hindfoot flow passages, and said distal forefoot region being substantially liquid free; and an elongated flow controller bridging the forefoot and midfoot regions of said bladder, the elongation of said flow controller substantially matching the longitudinal border between the medial longitudinal arch and the lateral longitudinal arch of the wearer's foot, said arch flow controller for restricting flow from said hindfoot region to said forefoot region and vice versa, and defining a semi-enclosed volume in which accumulation of liquid occurs when fluid flows into the medial longitudinal arch area, said accumulation forming a liquid pillow substantially matching the medial longitudinal arch area of the wearer's foot.

10. An insole as in claim 9, further comprising a layer of sweat absorbing material laminated to and substantially covering said outer surface of said upper layer of flexible material.

11. An improved insole as in claim 9, wherein said insole is adapted to be worn beneath the plantar surface of the wearer's foot, the foot having a first metatarsal, a second metatarsal and lateral metatarsal bones, and wherein one of said forefoot flow passages is matched to substantially underlie the first metatarsal bone of the wearer's foot, a second of said flow passages is matched to substantially underlie the second metatarsal bone of the wearer's foot, and each remaining flow passage matched to substantially underlie a respective one of the remaining lateral metatarsal bones of the wearer's foot.

12. An improved insole adapted to be worn beneath the wearer's foot, the foot having a first metatarsal, a second metatarsal and lateral metatarsal bones, a lateral longitudinal arch, a medial longitudinal arch and a border therebetween, said insole of the type in which a bladder is filled with a fluid, said bladder having a generally foot-shaped configuration with a proximal forefoot region, a hindfoot region and a midfoot region therebetween, wherein the improvement comprises:

at least two but no more than six transversely spaced forefoot flow deflectors in the proximal forefoot region of said bladder;

at least three but no more than seven forefoot flow passages between said flow deflectors and between the lateral and medial peripheral margins of the proximal forefoot region of said bladder, said forefoot flow passages being spaced transversely across the forefoot region of said bladder, one said forefoot flow passage matched to underlie the first metatarsal bone of the wearer's foot, a second of said forefoot flow passages to the second metatarsal bone of the wearer's foot, and the remaining flow passages matched to the lateral metatarsal bones of the wearer's foot, at least one of said forefoot flow passages extending between the proximal forefoot region and the midfoot region of said bladder;

a pair of flow restrictors in the proximal end of the proximal forefoot region, one said restrictor adjacent the medial peripheral margin of said bladder and the other adjacent the lateral peripheral margin, said pair of restrictors defining at least one longitudinal flow channel therebetween, said channel having a transverse width that is less than 50 per cent of the maximum straight transverse width of the forefoot region of said bladder;

at least one but no more than five transversely spaced hindfoot flow deflectors in the hindfoot region of said bladder;

at least two but no more than six hindfoot flow passages in the hindfoot region of said bladder, each said hindfoot flow passage having a transverse dimension that varies no more than ten percent from any other hindfoot flow passage, at least one of said heel flow passages extending from the hindfoot region to the midfoot region of said bladder;

a pair of hindfoot flow restrictors in the distal end of the hindfoot region of said bladder, one of said hindfoot flow restrictors adjacent the medial peripheral margin of said bladder and the other adjacent the peripheral lateral margin, said pair of hindfoot restrictors defining a substantially longitudinal hindfoot flow channel therebetween, said hindfoot channel having a transverse width of between 10 and 30 percent of the maximum straight transverse width of the hindfoot region of said bladder; and an elongated flow controller at least partially in both the proximal forefoot region and the midfoot region of said bladder, the elongation of said flow controller matching the border between the medial longitudinal arch and the lateral longitudinal arch of the wearer's foot, said controller for restricting flow from said hindfoot region to said proximal forefoot region and vice versa, and defining a semi-enclosed volume in which accumulation of liquid occurs when fluid flows into said medial arch region, said accumulation forming a liquid pillow substantially matching the medial longitudinal arch area of the wearer's foot.

* * * * *